US006708959B1

(12) United States Patent
Dow

(10) Patent No.: US 6,708,959 B1
(45) Date of Patent: Mar. 23, 2004

(54) CARBURETOR VALVE ASSEMBLY

(75) Inventor: Paul J. Dow, Cass City, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/702,470

(22) Filed: Oct. 31, 2000

(51) Int. Cl.[7] ..... F02M 17/40
(52) U.S. Cl. ..... 261/65
(58) Field of Search ..... 261/35, 65, 64.1, 261/DIG. 68

(56) References Cited

U.S. PATENT DOCUMENTS

| | | | | | |
|---|---|---|---|---|---|
| 3,214,150 | A | * | 10/1965 | Rice | 261/65 X |
| 3,265,050 | A | * | 8/1966 | Tuckey | 261/35 X |
| 3,561,736 | A | * | 2/1971 | Dye | 261/65 X |
| 3,852,379 | A | * | 12/1974 | Shishido et al. | 261/65 X |
| 4,139,580 | A | * | 2/1979 | Tuckey et al. | 261/DIG. 68 |
| 4,411,845 | A | * | 10/1983 | Tanahashi et al. | 261/65 |
| 4,561,158 | A | * | 12/1985 | Johnson et al. | 261/65 X |
| 4,752,420 | A | | 6/1988 | Nagasaka et al. | 261/35 |
| 4,961,355 | A | * | 10/1990 | Irino et al. | 261/65 X |
| 5,078,111 | A | * | 1/1992 | McCann | 261/65 X |
| 5,133,905 | A | | 7/1992 | Woody et al. | 261/35 |
| 5,275,375 | A | | 1/1994 | Semence | 251/308 |
| 5,554,322 | A | * | 9/1996 | Kobayashi | 261/35 |
| 5,666,988 | A | | 9/1997 | Becker | 137/15 |
| 6,059,271 | A | * | 5/2000 | Gerhardy | 261/35 |
| 6,202,989 | B1 | * | 3/2001 | Pattullo | 261/52 |

FOREIGN PATENT DOCUMENTS

| | | |
|---|---|---|
| DE | 10114994 | 10/2001 |
| EP | 0947681 | 10/1999 |
| JP | 11324735 | 11/1999 |
| JP | 11324736 | 11/1999 |

* cited by examiner

*Primary Examiner*—Richard L. Chiesa
(74) *Attorney, Agent, or Firm*—Reising, Ethington, Barnes, Kisselle, P.C.

(57) ABSTRACT

A carburetor with a valve assembly having a plastic cam body connected to a plastic shaft which extends into the carburetor body and a valve head press-fit into a slot formed through the plastic shaft. Desirably, the valve assembly eliminates the use of threaded fasteners and the need to swage or otherwise deform any of the components to connect them together. Desirably, the shaft and cam body are constructed and arranged to prevent relative rotation between them. This permits accurate location of the cam body on the shaft and facilitates calibration of the throttle valve assembly between its idle and wide open throttle positions. Further, the characteristics of the throttle valve assembly can be changed by simply providing a cam body having a different shape or construction with the shaft and/or valve disc being the same for a wide range of carburetors. The slot in the shaft is preferably longer than the diameter of the valve disc so that the valve disc may shift axially relative to the shaft so that it is self-centering within the fuel and air mixing passage. The valve disc can preferably also shift laterally relative to the shaft. This greatly facilitates assembly and manufacture of the throttle valve assembly by greatly increasing the tolerances with respect to the location of the valve disc on the valve shaft and of the slot.

24 Claims, 3 Drawing Sheets

CARBURETOR VALVE ASSEMBLY

FIELD OF THE INVENTION

This invention relates generally to carburetors and more particularly to a throttle valve assembly for a carburetor.

BACKGROUND OF THE INVENTION

Current throttle valves for carburetors have a metallic cam plate fastened tot to a metal shaft extending into the carburetor body and upon which a valve head is fixed to control the flow of air through the carburetor in response to rotation of the valve head. The cam plate is engageable with one or more stops on the carburetor body to limit rotation of the throttle valve assembly between idle and wide open throttle positions. The cam plate, shaft and valve head are machined and plated stamped parts. The cam plate is attached to the shaft with either a threaded fastener or by swaging over a portion of the shaft extending through the cam plate. The valve head may be a disc, such as in a butterfly-type valve arrangement, with the disc attached to the shaft with a threaded fastener. The machined or stamped components are relatively expensive to produce. Further, the use of threaded fasteners to connect the valve head to the shaft, and the cam plate to the shaft or the swaging of the shaft onto the cam plate greatly increases the cost, difficulty, time and labor required to assemble the throttle valve assembly.

Some carburetors have choke valves which may be closed to restrict the flow of air through the carburetor to facilitate starting of an associated engine. The choke valve may have a metal shaft extending into the carburetor body and a metal valve disc attached thereto by a threaded fastener which is received in and rotatable in the fuel and air mixing passage of the carburetor. The valve disc is rotated between a closed position substantially restricting air flow past the valve disc and an open position permitting a substantially unrestricted flow of air through the fuel and air mixing passage. Some choke valves have a plastic one-piece shaft with an integral handle which may be grasped by a user and rotated to move the choke valve between its open and closed positions. The valve disc may be press-fit into a slot formed through the shaft.

SUMMARY OF THE INVENTION

A carburetor with a throttle valve assembly having a plastic cam body connected to a plastic shaft which extends into the carburetor body and a valve head received in a slot formed through the plastic shaft. Desirably, the valve assembly eliminates the use of threaded fasteners and the need to swage or otherwise deform any of the components to connect them together. Desirably, the shaft and cam body are constructed and arranged to prevent relative rotation between them. This permits accurate location of the cam body on the shaft and facilitates calibration of the throttle valve assembly between its idle and wide open throttle positions. Further, the characteristics of the throttle valve assembly can be changed by simply providing a cam body having a different shape or construction with the shaft or valve head being the same for a wide range of carburetors. Still further, the slot in the shaft is preferably longer than the diameter of the valve head so that the valve head may shift axially on the shaft so that it is self-centering within the fuel and air mixing passage. The valve head can preferably also shift laterally relative to the shaft. This greatly facilitates assembly and manufacture of the throttle valve assembly by greatly increasing the tolerances with respect to the location of the valve head on the valve shaft and of the slot receiving the valve head.

Objects, features and advantages of this invention include providing a valve assembly which utilizes a plastic cam body connected to a plastic shaft, permits different cam bodies to be used with the same shaft and valve disc for different carburetors, self-centers and assures smooth movement of the valve disc within the fuel and air mixing passage, is lightweight and inexpensive to manufacture and assemble, eliminates the use of machined or stamped metal components for at least the shaft and cam body, eliminates the use of threaded fasteners or mechanical deformation such as swaging to connect components together, has improved corrosion resistant characteristics, reduces the time and cost to assemble the throttle valve assembly into a carburetor, is reliable, durable, rugged and in service has a long, useful life.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENT

Figure 1:
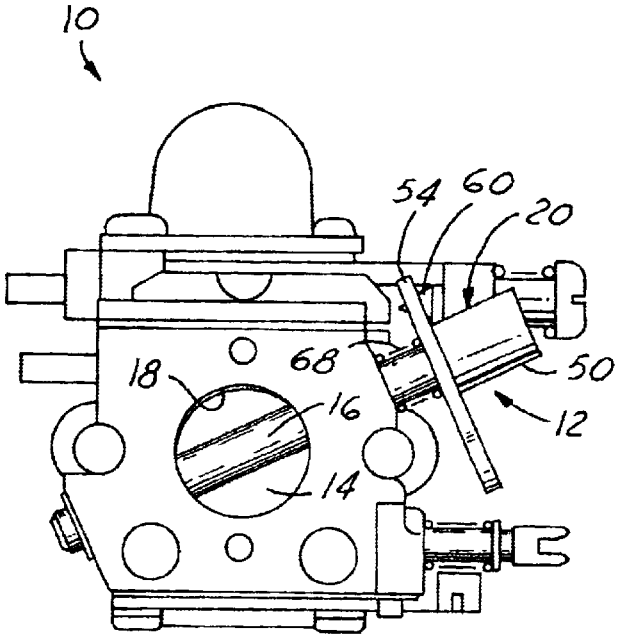
FIG. 1 is an end view of a carburetor having a throttle valve assembly according to the present invention.
Figure 2:
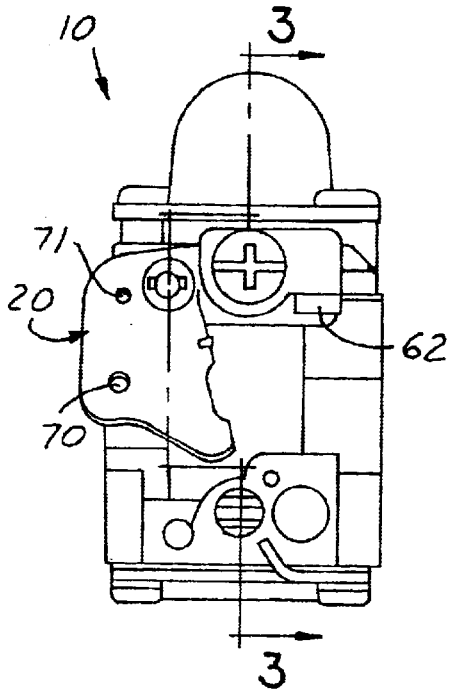
FIG. 2 is a side view of the carburetor of FIG. 1.
Figure 3:
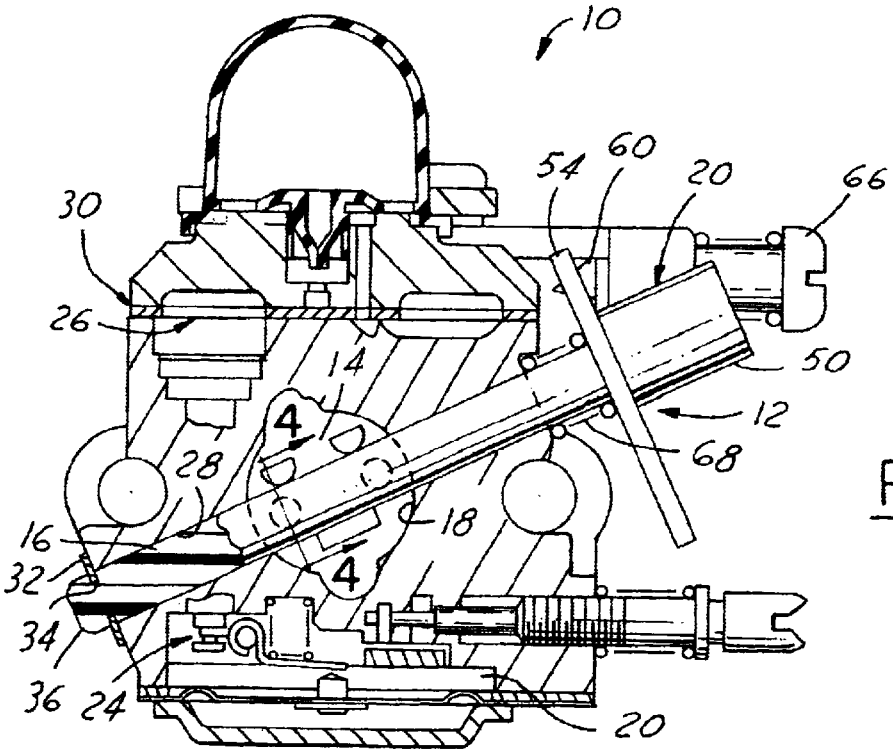
FIG. 3 is a cross-sectional view taken generally along lines 3—3 of FIG. 2.

Referring in more detail to the drawings, FIGS. 1–3 illustrate a carburetor 10 having a throttle valve assembly 12 including a valve head 14 rotatably carried by a shaft 16 within a fuel and air mixing passage 18 of the carburetor 10 to control fluid flow therethrough. Rotation of the throttle valve assembly 12 is typically accomplished by a Boden cable and wire assembly (not shown) which is attached to and drives a throttle cam body 20 connected to the shaft 16 for rotation therewith. The throttle valve assembly 12 rotates from an idle position as shown in FIG. 1, substantially preventing fluid (namely, air) flow through the fuel and air mixing passage 18, and a wide open throttle position permitting a substantially unrestricted flow of fluid through the fuel and air mixing passage 18. In general, as shown in FIG. 3, fuel is discharged into the fuel and air mixing passage 18 from a fuel metering chamber 22 which receives fuel through a diaphragm actuated inlet valve 24 which selectively communicates the fuel metering chamber 22 with a diaphragm-type fuel pump 26 which draws fuel from a fuel tank for delivery to the fuel metering chamber 22. Fuel discharged from the fuel metering chamber 22 into the fulel and air mixing passage 18 is mixed with air flowing therethrough and is delivered to the engine in proportion to the engine's fuel demand to support engine operation over a wide range of operating conditions. The construction and operation of the fuel metering chamber 22, valve 24, fuel pump 26, and related components may be as disclosed is U.S. Pat. No. 4,752,420, the disclosure of which is incorporated herein by reference in its entirety.

The throttle valve assembly 12 has the shaft 16 which extends through a bore 28 through a body 30 of the carburetor 10 at a right angle to and intersecting the fuel and air mixing passage 18. A split ring retainer 32 cooperates with a groove 34 at a first end 36 of the shaft 16 projecting from the carburetor body 30 to retain the shaft 16 within the body 30. As best shown in FIGS. 5, 6 and 10–12, the shaft 16 is generally cylindrical with a second end 38 constructed to be disposed within a complementary recess or passage 40 in the cam body 20. Adjacent the second end, a pair of flat sides 42, 44 are formed on opposite sides of the shaft 16. A groove 46 is formed at least in part around the shaft 16 inboard of its second end 38 and within the area of the flat sides 42, 44. An elongate slot 48 formed through the shaft 16 between its ends 36, 38 is constructed to receive the valve head 14 therein to connect them together. The shaft 16 is preferably formed of a plastic or polymeric material and may be readily molded such as by an injection molding or other molding process.

As best shown in FIGS. 6–9, the cam body 20 has a generally tubular barrel portion 50 having a non-circular recess or passage 40 in which the second end 38 of the shaft 16 is pressed to connect the cam body 20 and shaft 16 together. At least a portion of the passage 40 is defined by at least two and preferably four flat surfaces or shoulders 52 which, in assembly, bear on and engage the flat sides 42, 44 of the shaft 16 to prevent relative rotation between the shaft 16 and cam body 20. A plate portion 54 of the cam body 20 extends outwardly from the barrel portion 50 and defines two stop surfaces 56, 58 engageable with associated stops 60, 62 carried by the carburetor body 30 to limit rotation of the throttle valve assembly 12. Preferably, at least one of the stops 60 of the carburetor body 30 is adjustable and as shown, is defined by a conical end of a screw 66 which may be advanced or retracted relative to the carburetor body 30 to change the location of engagement between the cam body stop 56 and the carburetor body stop 60 defined by the end of the screw 66. Accordingly, the circumferential spacing between the stops 56, 58 of the cam body 20 as well the location of the stops 60, 62 on the carburetor body 30 determines the amount of rotation of the throttle valve assembly 12 between its idle and wide open throttle positions. Desirably, a spring 68 which bears on the cam body 20 yieldably biases the throttle valve assembly 12 to its idle position as shown in FIGS. 1–3. One or more holes 70 are preferably provided through the plate 54 spaced from the barrel portion 50 to facilitate connection with the wire of the Boden wire cable assembly (not shown) which drives the throttle valve assembly 12 for rotation. A hole 71 may receive one finger or end of the spring 68 which yieldably biases the throttle valve assembly 12 to its idle position.

Figure 8:
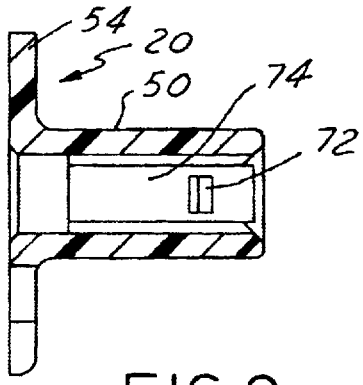
FIG. 8 is a cross sectional view of the cam body taken generally along line 8—8 of FIG. 7.
Figure 9:
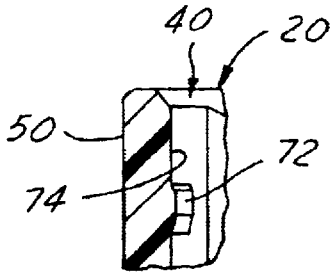
FIG. 9 is a fragmentary sectional view taken generally along line 9—9 of FIG. 7.
Figure 10:
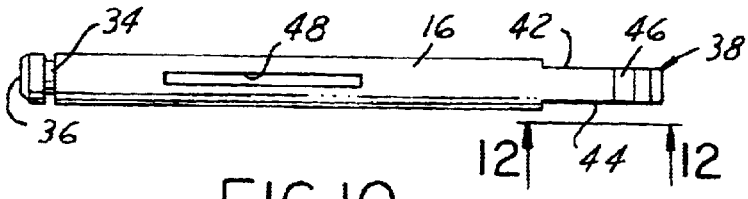
FIG. 10 is a side view of the throttle shaft.
Figure 11:
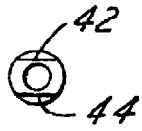
FIG. 11 is an end view of the throttle shaft.
Figure 12:
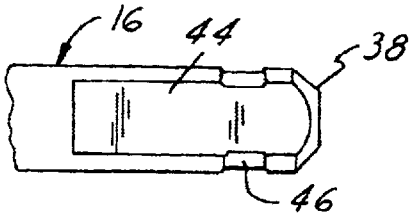
FIG. 12 is an enlarged fragmentary view of an end portion of the throttle shaft.
Figure 13:
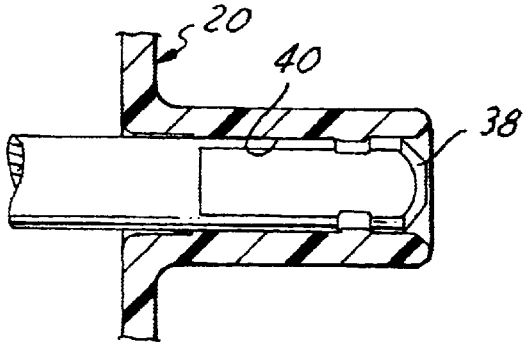
FIG. 13 is an enlarged fragmentary cross-sectional view illustrating the connection between the throttle shaft and cam body.

As best shown in FIGS. 8 and 9, to retain the cam body 20 on the shaft 16 and prevent their inadvertent separation, the cam body 20 has at least one and preferably a plurality of barbs or tabs 72 extending radially inwardly from an inner wall 74 of the barrel 50 into the passage 40. In assembly, the cam body 20 is pressed onto the shaft 16 until the tabs 72 pass over the second end 38 of the shaft 16 and are received within the groove 46 adjacent to the second end 38 to retain the cam body 20 on the shaft 16 with an interference fit. The cam body 20 is preferably formed of a plastic or polymeric material and may be molded separately from the shaft 16 to permit different cam bodies to be used with the same shafts for different carburetor applications. Alternatively, the shaft 16 and cam body 20 may be integrally formed together in one piece to eliminate the need for the structures preventing relative rotation between the shaft 16 and cam body 20 and the structures retaining the them together.

Figure 4:
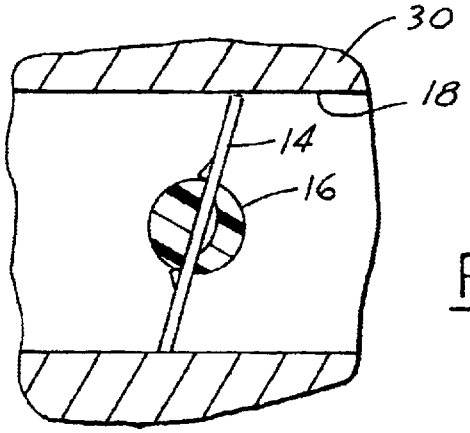
FIG. 4 is an enlarged fragmentary sectional view taken generally along line 4—4 of FIG. 3.
Figure 5:
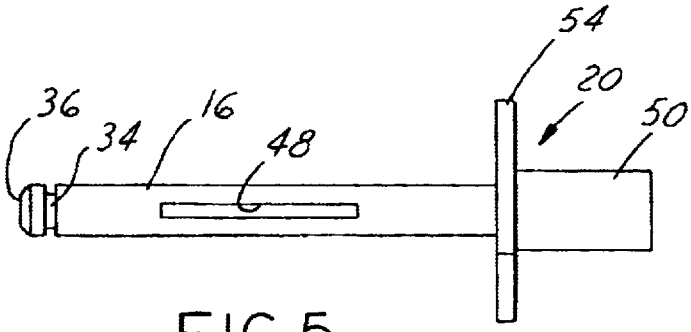
FIG. 5 is a side view illustrating a throttle cam body connected to a throttle shaft.
Figure 6:
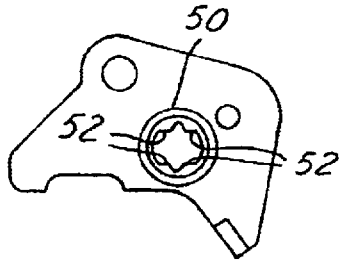
FIG. 6 is an end view of the cam body and shaft.
Figure 7:
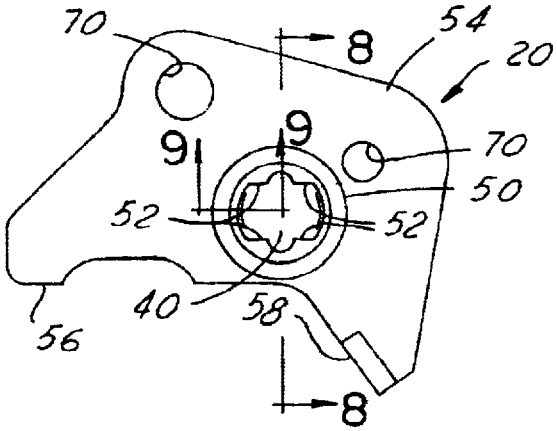
FIG. 7 is an enlarged end view of the cam body.
Figure 14:
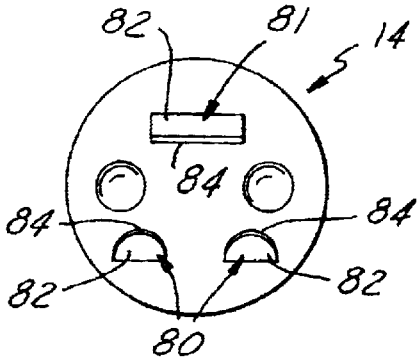
FIG. 14 is a plan view of a valve disc.
Figure 15:
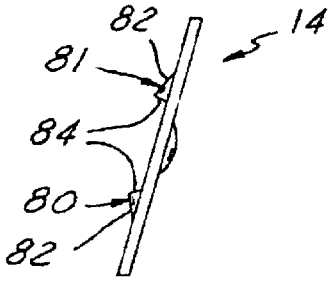
FIG. 15 is a side view of the valve disc of FIG. 14.

As best shown in FIGS. 4, 14 and 15, the valve head 14 is preferably a generally flat circular plate or disc which may be formed of a metallic or polymeric material. The valve head 14 has a plurality of raised, inclined retainer tabs 80, 81 preferably integrally formed therewith. Desirably, as shown in FIG. 15, the tabs 80, 81 are laterally spaced from the center of the valve head 14 and have ramps 82 leading to opposing stop surfaces 84 constructed to bear on the throttle shaft 16 to retain the valve head 14 in the slot 48 of the shaft 16. In assembly, the valve head 14 is pressed or pushed into the shaft 16 until the tab or tabs 80 on one side of the valve head 14 are forced through the slot 48 and the shaft 16 is received between the opposed laterally spaced tabs 80, 81. Desirably, due to the inclined or ramp surfaces 82 of the tabs 80, 81 it is relatively easy to push the valve head 14 into the slot 48 in shaft 16. However, it is difficult to remove the valve head 14 from the shaft 16 due to the abrupt stop surfaces 84 which oppose such movement of the valve head 14. Accordingly, inadvertent separation of the valve head 14 and shaft 16 is prevented.

Desirably, the valve head 14 is slidably carried by the shaft 16 so that it is self-centering within the fuel and air mixing passage 18. To accomplish this, the slot 48 formed in the shaft 16 preferably has a length greater than the diameter of the valve head 14 to permit shifting of the valve head 14 axially relative to the shaft 16. The slot also has a length at least equal to and preferably greater than the diameter of the fuel and air mixing passage 18 with the slot 48 spanning the entire fuel and air mixing passage 18 so that the valve-head 14 is self-centering therein. Further, to permit lateral shifting of the valve head 14 relative to the shaft 16 and thereby further enable the valve head 14 to center itself in passage 18, the distance between the stop surfaces 84 of the opposed laterally spaced tabs 80, 81 is preferably greater than the outer diameter of the shaft 16. In this manner, the tolerances of the valve head 14 and shaft 16 are greatly increased to facilitate their manufacture and assembly both with respect to each other and their assembly into the carburetor 10.

The shaft 16, cam body 20 and valve head 14 may be formed from any suitable polymeric material with currently preferred materials including, without limitation, acetal copolymers such as those sold under the trademarks Delrin 500 and Celcon M-90. The valve head 14 may also be formed of brass or other metal. Desirably, the throttle valve assembly 12 can be assembled without the use of any fasteners, adhesives or the like. Further, the use of machined, stamped or other costly to manufacture components can be at least substantially reduced, and preferably eliminated. Still further, the valve head 14 and shaft 16 can be used with a wide range of cam bodies 20 to increase the versatility of the throttle valve assembly 12 for a wide range of carburetors 10 and engine applications. Accordingly, the cost to manufacture and assemble the throttle valve assembly 12 itself as well as to install the throttle valve assembly 12 into a carburetor 10 is significantly reduced. The polymeric materials are also cheaper and have greater resistance to corrosion than their metal counterparts.

What is claimed is:

1. A carburetor, comprising:

a metallic carburetor body having a fuel and air mixing passage through which a fuel and air mixture is delivered to an engine;

a throttle valve assembly movable in the fuel and air mixing passage between idle and wide open positions, said valve assembly having a polymeric shaft rotatable relative to the carburetor body;

a separate polymeric cam body connected to the shaft for rotation in unison with the shaft;

a separate valve head in communication with the fuel and air mixing passage and carried by the shaft for rotation in unison with the shaft;

the shaft being journalled for rotation in integral bores, in one portion of the carburetor body;

the cam body being configured to be connected to an actuator wire for movement of the shaft and valve head between the idle and wide open positions; and at least one stop carried by the carburetor body and engageable by the cam body to limit rotation of the valve assembly to at least one of the idle position and wide open throttle position of the valve head of the valve assembly.

2. The carburetor of claim 1 wherein the shaft has an elongate slot formed therethrough and the valve head is carried by the shaft within the slot.

3. The carburetor of claim 2 wherein the valve head has raised tabs which are engageable with the shaft to retain the valve head in the slot.

4. The carburetor of claim 3 wherein the tabs define stop surfaces with at least one stop surface disposed on each of a pair of opposed sides of the shaft in assembly with the distance between the stop surfaces on opposed sides of the shaft being greater than the diameter of the shaft.

5. The carburetor of claim 2 wherein the valve head is generally circular and the slot has a length greater than the diameter of the valve head so that the valve head can shift within the slot generally axially relative to the shaft.

6. The carburetor of claim 5 wherein the length of the slot is at least equal to the diameter of the fuel and air mixing passage with the slot spanning the entire fuel and air mixing passage.

7. The carburetor of claim 2 wherein the elongate slot in the shaft has a length greater than the width of the portion of the valve head received in the slot and greater than the width of the mixing passage at the location where the shaft extends across the mixing passage.

8. The carburetor of claim 1 wherein the cam body is pressed onto the shaft and is retained on the shaft by an interference fit.

9. The carburetor of claim 1 wherein the shaft has a flat surface and the cam body has at least one shoulder which engages the flat surface of the shaft to prevent relative rotation between the shaft and cam body.

10. The carburetor of claim 9 wherein the shaft has another flat surface and the cam body has another shoulder which engages said another flat surface.

11. The carburetor of claim 10 wherein the cam body has four spaced apart shoulders with each flat surface engaged by two shoulders.

12. The carburetor of claim 1 which also comprises a pair of stops carried by the carburetor body and wherein the cam body has a pair of stops each constructed to engage a separate one of the stops carried by the carburetor body to limit rotation of the valve assembly.

13. A carburetor, comprising:

a carburetor body having a fuel and air mixing passage through which air flows and through which fuel is delivered to an engine;

a valve assembly movable in the fuel and air mixing passage between first and second positions, said valve assembly having a polymeric shaft rotatable relative to the carburetor body;

a polymeric cam body connected to the shaft for rotation with the shaft;

a valve head in communication with the fuel and air mixing passage and carried by the shaft for rotation with the shaft; and the shaft has a groove formed therein and the cam body has a bore and a tab extending into the bore with the tab constructed and arranged to be received in the groove when the cam body is fully received on the shaft.

14. A throttle valve assembly for a carburetor comprising:

a carburetor body with a fuel and air mixing passage;

a throttle polymeric shaft rotatably carried by the carburetor body in communication with the fuel and air mixing passage and having a slot formed therethrough between its ends;

a throttle cam body connected to the shaft for co-rotation in unison with the shaft to engage at least one stop carried by the carburetor body to limit rotation of the throttle valve assembly;

a valve head carried by the shaft for rotation in unison with the shaft, in communication with the fuel and air mixing passage and disposed in part in the slot so that rotation of the shaft changes orientation of the valve head relative to the fuel and air mixing passage to control fluid flow through the fuel and air mixing passage; and the length of the slot through the shaft being greater than the width of the portion of the valve head received in the slot of the shaft and greater than the width of the mixing passage at the location of the shaft in the mixing passage so that the valve head is movable axially relative to the shaft and transversely relative to the mixing passage to center the valve head in the mixing passage.

15. The valve assembly of claim 14 wherein the valve head has at least two spaced apart tabs and when assembled to the shaft at least one of said tabs is disposed on each of a pair of opposed sides of the shaft to retain the valve head in the slot and on the shaft.

16. The valve assembly of claim 14 wherein the valve head is generally circular and generally flat, and the slot has a length greater than the diameter of the valve head so that the valve head can shift within the slot generally axially relative to the shaft.

17. The valve assembly of claim 14 wherein the slot spans the entire fuel and air mixing passage, the shaft is journalled for rotation at least in part beyond each end of the slot, a spring is received over the shaft between the cam body and the carburetor body, and a retainer is received on the shaft adjacent an end of the shaft distal from the cam body and adjacent the carburetor body.

18. The valve assembly of claim 14 wherein the shaft has a flat surface and the cam body has at least one shoulder which engages the flat surface of the shaft to prevent relative rotation between the shaft and cam body.

19. The valve assembly of claim 14 wherein the cam body is integrally formed with the shaft.

20. The valve assembly of claim 14 wherein the cam body is pressed onto the shaft and is retained on the shaft by an interference fit.

21. The valve assembly of claim 20 wherein the shaft has a groove formed therein and the cam body has a throughbore and a tab extending into the throughbore with the tab constructed and arranged to be received in the groove when the cam body is fully received on the shaft.

22. The valve assembly of claim 14 wherein the shaft has a portion with a non-circular cross-section constructed and arranged to be received in a complimentary non-circular recess in the cam body to prevent relative rotation between the shaft and the cam body.

23. A valve assembly comprising:

a carburetor body with a mixing passage, and a pair of coaxial bores on opposite sides of the mixing passage and extending substantially transversely to the longitudinal axis of the mixing passage;

a polymeric valve shaft extending transversely through the mixing passage, journalled for rotation in the bores, and having a slot therethrough between its ends;

a valve head received in the mixing passage, disposed in the slot and carried by the shaft for rotation in unison with the shaft so that rotation of the shaft changes the orientation of the valve head relative to the mixing passage to control fluid flow through the mixing passage; and the length of the slot through the shaft being greater than the width of the portion of the valve head disposed in the slot of the shaft and greater than the width of the mixing passage at the location of the shaft in the mixing passage so that the valve head is movable axially relative to the shaft and movable transversely relative to the shaft and the mixing passage to center the valve head in the mixing passage.

24. A valve assembly comprising:

a carburetor body with a mixing passage, and a pair of coaxial bores on opposite sides of the mixing passage and extending substantially transversely to the longitudinal axis of the mixing passage;

a polymeric valve shaft extending transversely through the mixing passage, journalled for rotation in the bores, and having a slot the therethrough between its ends;

a valve head received in the mixing passage, disposed in the slot and carried by the shaft for rotation in unison with the shaft so that rotation of the shaft changes the orientation of the valve head relative to the mixing passage to control fluid flow through the mixing passage;

the length of the slot through the shaft being greater than the width of the portion of the valve head disposed in the slot of the shaft and greater than the width of the mixing passage at the location of the shaft in the mixing passage so that the valve head is movable axially relative to the shaft and movable transversely relative to the shaft and the mixing passage to center the valve head in the mixing passage, and the valve head also comprises at least two spaced-apart stops with at least one stop disposed on each of opposite sides of the shaft with the distance between the stops on opposed sides of the shaft being greater than the portion of the shaft received between the stops so that the stops limit the extent to which the valve head can move transversely to the shaft and the valve head can shift transversely to the axis of the shaft to center the valve head in the mixing passage when the shaft is rotated to cause the valve head to at least substantially close the mixing passage.

* * * * *